US007862030B2

(12) United States Patent
Igarashi

(10) Patent No.: US 7,862,030 B2
(45) Date of Patent: Jan. 4, 2011

(54) RECORDING MEDIUM CONVEYING DEVICE, IMAGE FORMING APPARATUS AND CARTRIDGE

(75) Inventor: Hiroshi Igarashi, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 12/369,931

(22) Filed: Feb. 12, 2009

(65) Prior Publication Data

US 2009/0152791 A1 Jun. 18, 2009

Related U.S. Application Data

(62) Division of application No. 11/236,547, filed on Sep. 28, 2005, now Pat. No. 7,506,866.

(30) Foreign Application Priority Data

Sep. 29, 2004 (JP) ..... 2004-285073

(51) Int. Cl.
*B65H 5/00* (2006.01)

(52) U.S. Cl. ..... 271/10.1; 271/4.1

(58) Field of Classification Search ..... 271/4.1, 271/10.1

See application file for complete search history.

(56) References Cited

U.S. PATENT DOCUMENTS 3,155,546 A 11/1964 Dirks
3,618,938 A 11/1971 Pollak, Jr. et al.
4,768,063 A 8/1988 Kunishima et al.
4,941,021 A 7/1990 Uchida et al.
5,142,760 A 9/1992 Bell
5,216,475 A 6/1993 Ohno
5,331,390 A 7/1994 Kimura et al.
5,414,492 A 5/1995 Kubota
5,444,515 A 8/1995 Haneda et al.

(Continued)

FOREIGN PATENT DOCUMENTS

EP 1031891 A1 8/2000

(Continued)

OTHER PUBLICATIONS

EP Search Report and Search Opinion dated Jun. 5, 2007, EP Application 05021358.6, 16 pages.

(Continued)

*Primary Examiner*—Stefanos Karmis
*Assistant Examiner*—Howard Sanders
(74) *Attorney, Agent, or Firm*—Banner & Witcoff, Ltd.

(57) ABSTRACT

A first guide member includes a concave-shaped guide surface. A recording medium such as a sheet fed by register rollers takes a curved position while being fed in a sheet feeding direction such that the leading edge of the sheet slides on the guide surface. A space is defined between the sheet and the guide surface due to the stiffness of the sheet. Thus, the sheet smoothly curves. When a speed of conveying the sheet by the register rollers is faster than a speed of conveying the sheet by a conveying belt, slack in the sheet is allowed in the space defined between the sheet and the guide surface. Therefore, the sheet can be stably conveyed without applying excessive load to the sheet or a sheet conveying device.

8 Claims, 11 Drawing Sheets

U.S. PATENT DOCUMENTS

| | | | | |
|---|---|---|---|---|
| 5,678,122 | A | 10/1997 | Gross | |
| 5,933,697 | A | 8/1999 | Onodera et al. | |
| 6,027,108 | A | 2/2000 | Johdai et al. | |
| 6,206,368 | B1 | 3/2001 | Kobayashi et al. | |
| 6,457,705 | B2 | 10/2002 | Nanba et al. | |
| 6,519,441 | B1 | 2/2003 | Sawada | |
| 6,550,759 | B2 | 4/2003 | Kotaka et al. | |
| 6,565,077 | B2 | 5/2003 | Kawada | |
| 6,644,187 | B2 | 11/2003 | Okamoto et al. | |
| 6,708,011 | B2 | 3/2004 | Nomura et al. | |
| 6,738,590 | B2 | 5/2004 | Okimura et al. | |
| 2002/0044810 | A1 | 4/2002 | Sato et al. | |
| 2002/0067927 | A1 | 6/2002 | Matsunai | |
| 2003/0053819 | A1 | 3/2003 | Nomura et al. | |
| 2003/0209852 | A1 | 11/2003 | Choi | |
| 2003/0230845 | A1 | 12/2003 | Fujii et al. | |
| 2004/0126136 | A1 | 7/2004 | Toba et al. | |
| 2004/0130088 | A1 | 7/2004 | Sato et al. | |
| 2005/0053388 | A1 | 3/2005 | Tokoyama et al. | |
| 2007/0231032 | A1* | 10/2007 | Matsuno | 399/388 |
| 2009/0189340 | A1* | 7/2009 | Aoi | 271/264 |

FOREIGN PATENT DOCUMENTS

| | | | |
|---|---|---|---|
| FR | 2070865 | A1 | 9/1971 |
| GB | 1217376 | A | 12/1970 |
| JP | 59-220758 | A | 12/1984 |
| JP | 60-170340 | U | 11/1985 |
| JP | 01-019530 | A | 1/1989 |
| JP | 1081734 | | 3/1989 |
| JP | 04-149569 | A | 5/1992 |
| JP | 04-308866 | A | 10/1992 |
| JP | 05-011632 | A | 1/1993 |
| JP | 05-072837 | A | 3/1993 |
| JP | 05-162881 | A | 6/1993 |
| JP | 05-229686 | | 9/1993 |
| JP | 05-330689 | A | 12/1993 |
| JP | 06-183056 | A | 7/1994 |
| JP | 07-304540 | A | 11/1995 |
| JP | 09-197736 | | 7/1997 |
| JP | 09-204083 | | 8/1997 |
| JP | 09-235041 | A | 9/1997 |
| JP | 09-325544 | | 12/1997 |
| JP | 10-186789 | A | 7/1998 |
| JP | 10-194530 | | 7/1998 |
| JP | 10-274872 | A | 10/1998 |
| JP | 11-327246 | | 11/1999 |
| JP | 2001-331003 | | 11/2001 |
| JP | 2001-341890 | A | 12/2001 |
| JP | 2001-350307 | A | 12/2001 |
| JP | 2002-323833 | A | 11/2002 |
| JP | 2004-168534 | A | 6/2004 |
| JP | 2004-217331 | A | 8/2004 |

OTHER PUBLICATIONS

JP Office Action Nov. 8, 2007, JP Application 2004-285073 (see concise statement).

EP Office Action dtd Mar. 25, 2010, EP Appln. 05021358.6.

Examiner's Opinion mailed Jul. 17, 2009 in Japanese Appeal No. 2008-10104 ( Application No. JP2004-285073) and Partial English translation thereof.

* cited by examiner

RECORDING MEDIUM CONVEYING DEVICE, IMAGE FORMING APPARATUS AND CARTRIDGE

CROSS REFERENCE TO RELATED APPLICATION

This application is a divisional of prior U.S. application Ser. No. 11/236,547, filed Sep. 28, 2005, which claims priority from Japanese Patent Application No. 2004-285073, filed Sep. 29, 2004, the entire subject matter of which is incorporated herein by reference.

TECHNICAL FIELD

Aspects of the invention relate to a recording medium conveying device, an image forming apparatus and a cartridge.

BACKGROUND

Known electrophotographic image forming apparatuses include a so-called "direct tandem printer", which is a type of tandem printer that does not employ an intermediate belt transfer system. The direct tandem printer generally includes four photosensitive drums, one for each color, yellow, magenta, cyan and black, a conveying belt for transferring a recording medium, such as a sheet, and four transfer rollers disposed so as to face respective photosensitive drums with the conveying belt between the photosensitive drums and the transfer rollers. A sheet is supplied from, for example, a sheet supply cassette. The sheet is fed onto the conveying belt after the skew of the sheet is corrected by register rollers. While the sheet is fed by the conveying belt between the photosensitive drums and the transfer rollers, toner images formed on each of the photosensitive drums are sequentially transferred onto the sheet.

When the speed of the register rollers conveying a sheet is the same as the speed of the conveying belt conveying a sheet, there likely will be no problems in conveying the sheet. However, it is practically impossible to keep both speeds exactly the same, for example, due to the dimensional tolerances, such as the outside diameters of the register rollers and conveying belt drive rollers. When the speed of the conveying belt conveying the sheet is greater than the speed of the register rollers conveying the sheet, the sheet experiences a tension when contacting both the conveying belt and the register rollers. In this case, the sheet might be pulled with excessive force toward an upstream side in a sheet feeding direction, or the trailing edge of the sheet may be moved or vibrated when the sheet passes through the register rollers and the tension between the conveying belt and register rollers is released. Such vibration in the sheet causes color registration problems. To solve the color registration problems, the speed of the register rollers conveying a sheet is set greater than the speed of the conveying belt conveying a sheet as disclosed in Japanese Laid-Open Patent Publication No. 10-194530.

When the speed of the register rollers conveying a sheet is set greater than the speed of the conveying belt conveying a sheet as disclosed in Japanese Laid-Open Patent Publication No. 10-194530, the sheet experiences slack between the conveying belt and the register rollers. If a sheet fed by the register rollers is conveyed to the conveying belt in a substantially flat position, the sheet does not readily experience slack especially when the sheet is stiff. In this case, the sheet may be pushed or slid over the conveying belt toward a downstream side in the sheet feeding direction by the register rollers.

To make the sheet readily experience slack, it would be helpful if that the sheet were curved while being conveyed between the conveying belt and the register rollers so as to allow the slack in the sheet. However, structures of a first guide member for curving the sheet fed by the register rollers while allowing slack in the sheet do not exist. Therefore, the sheet may not be curved smoothly or readily experience slack due to the stiffness of the sheet. Consequently, improper sheet feeding can occur which can result in damage to the sheet.

SUMMARY

Aspects provide a recording medium conveying device that can readily curve and provide slack to a recording medium being conveyed. The recording medium conveying device may be provided in an image forming apparatus and with a cartridge.

BRIEF DESCRIPTION OF THE DRAWINGS

Illustrative aspects will be described in detail with reference to the following figures wherein.

DETAILED DESCRIPTION

General Overview

Figure 1:
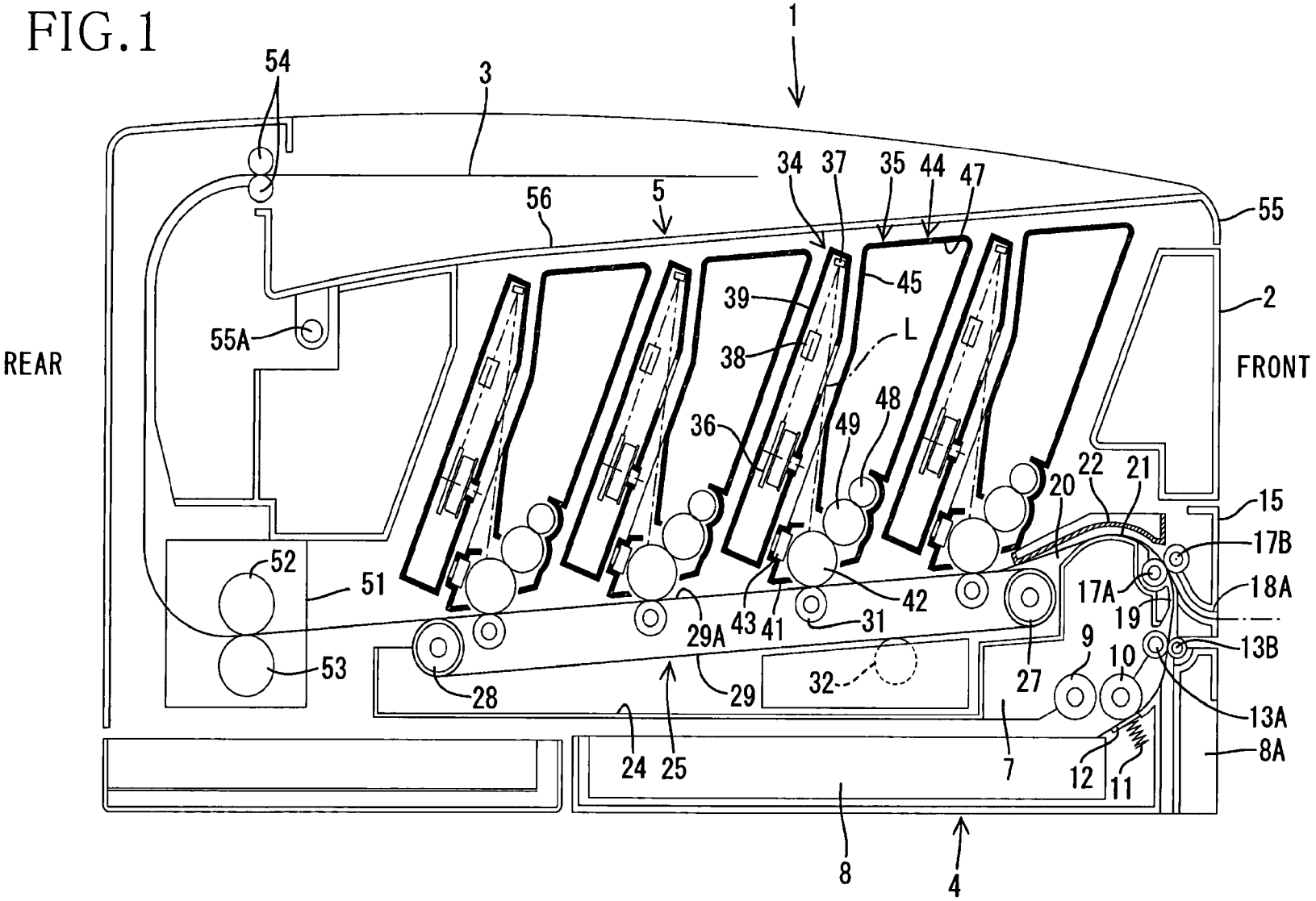
FIG. 1 is a side sectional view of an overall configuration of a color laser printer according to an illustrative aspect.

In aspects, a recording medium conveying device may include a conveyor such as a conveying belt configured to convey a recording medium, a feeding roller configured to feed the recording medium toward the conveyor, and a first guide member, such as a chute, configured to guide the recording medium fed by the feeding roller onto the conveyor. The first guide member may be disposed between the conveyor and the feeding roller. The first guide member may have a guide portion over which a leading edge of the recording medium slides and may have a concave guide portion.

In aspects of the recording medium conveying device, the concave guide portion may be configured to allow the recording medium to gradually curve while being fed in the feeding direction. With such a structure, when the recording medium fed by the feeding roller is conveyed in the feeding direction while the leading edge of the recording medium slides over the concave guide portion, a portion of the recording medium between the leading edge thereof and a nip portion between feeding rollers may gradually curve. To account for the stiffness of the recording medium, a space may be defined between the guide portion and the recording medium. In at least some aspects, the recording medium may curve smoothly. According to aspects, the recording medium may be fed stably without applying excessive loads to a recording medium conveying device. The recording medium may be prevented from experiencing excessive tension in at least some aspects.

In aspects of the recording medium conveying device, the recording medium fed from the first guide member may contact, a conveying surface of the conveyor at an angle of 5-45 degrees. If the recording medium fed from the first guide member contacts a surface of the conveyor substantially parallel with the conveying surface, the recording medium may be lifted from the conveying surface. However, with the above-described structure, the recording medium may be pressed against the conveying surface thereby making close contact with the conveying surface.

In aspects of the recording medium conveying device, a formula $Vr>Vb$ may be established where $Vr$ is a speed of the feeding roller which conveys the recording medium and $Vb$ is a speed of the conveyor which conveys the recording medium. Therefore, poor image formation may be prevented due to the unstable feeding of the recording medium caused by, for example, the recording medium pulling between a conveying belt of the conveyor and the feeding roller. Further, slack in the recording medium may be allowed in the space defined between the recording medium and the guide portion. Thus, the recording medium may be readily curved.

In some aspects of the recording medium conveying device, the feeding roller may reduce skew of the recording medium. With such a structure, the image forming apparatus can be simplified without having to additionally provide a register roller.

In aspects of the recording medium conveying device, a leading edge of the recording medium makes contact with the guide portion at an angle of less than or equal to 45 degrees. When the leading edge of the recording medium contacts the guide portion at a greater contact angle, loads applied to the recording medium may become greater and consequently, the leading edge of the recording medium may be damaged. With the above-described structure, the leading edge of the recording medium may contact the guide portion at a slight angle. Thus, damage to the recording medium may be prevented.

In other aspects, the recording medium conveying device may further include a second guide member such as an inner chute opposed to the first guide member, where a region between the first and second guide members defines a feeding path of the recording medium. The second guide member may have a convex guide portion over which the recording medium may slide. With such a structure, the recording medium may be smoothly guided. For example, even when the trailing edge of the recording medium vibrates in a thickness direction of the recording medium, the vibration may be reduced.

In other aspects of the recording medium conveying device, the first guide member being configured to be moved to allow access to a feeding path of the recording medium. Therefore, clearing a recording medium jam occurring at an inner side of the first guide member may be readily performed.

In some aspects of the recording medium conveying device, the feeding roller may be configured to feed the recording medium in a direction between a feeding direction of the recording medium on a conveying surface of the conveyor and a direction perpendicular to the feeding direction of the recording medium on the conveying surface. With such a structure, even when an image forming apparatus is downsized, the curvature the recording medium experiences in the conveying path may be restricted.

In other aspects of the recording medium conveying device, the conveyor includes a conveying belt that may be supported by belt supporting rollers. The first guide member may be configured to make the leading edge of the recording medium contact a conveying surface of the conveying belt downstream of a supporting position of a belt supporting roller that contacts the conveying belt and is disposed nearest to the first guide member. The leading edge of the recording medium, which is fed along the first guide member, slightly vibrates. If the leading edge of the recording medium fed along the first guide member contacts the conveying belt where the belt supporting roller is supported, a contact position of the leading edge of the recording medium to the conveying belt may be shifted greatly due to the vibrations of the leading edge of the recording medium, and because the supporting position of the belt supporting roller in the conveying belt is relatively uneven. Consequently, the accuracy associated with feeding the recording medium may become poor. With the above-described structure, the leading edge of the recording medium may contact the substantially flat portion of the conveying belt, other than at the position of the belt supporting roller in the conveying belt. Therefore, a favorable feeding accuracy of the recording medium may be maintained while reducing the influence of vibrations on the leading edge of the recording medium.

In the recording medium conveying device, the first guide member may be provided with an extended guide portion that extends immediately proximate to the feeding roller from the guide portion. The recording medium may be slidable over the extended guide portion. With such a structure, for example, movement or vibration of the trailing edge of the recording medium may be prevented when the recording medium passes the feeding roller.

In certain aspects of the recording medium conveying device, the first guide member may include a reinforcing edge at a downstream end of the feeding path of the recording medium associated with the first guide member, the reinforcing edge extending in a direction away from the feeding path of the recording medium. The reinforcing edge may be formed into a substantially rectangular shape. With the reinforcing edge, the strength of the end of the first guide member may be increased.

In other aspects, an image forming apparatus may include the recording medium conveying device as described according to the above aspects; a photosensitive drum configured to carry an electrostatic latent image thereon, the photosensitive drum opposing the conveying belt; a developer configured to form a visible image by applying a developing agent to the electrostatic latent image formed on the photosensitive drum, the developer opposing the photosensitive drum; and a transfer device configured to transfer the visible image onto the recording medium conveyed on the conveyor. With such a structure, a high-quality image may be formed because the feeding accuracy of the recording medium may be maintained by the recording medium conveying device provided with the first guide member having the guide portion.

In aspects of the image forming apparatus, the conveyor may include a conveying belt and the transfer device may include a transfer roller. The transfer roller may be disposed on an inner side of the conveying belt, downstream of a belt supporting roller that contacts the conveying belt and is disposed nearest to the first guide member. The first guide member may be configured to make the leading edge of the sheet contact the conveying belt between the supporting position of the belt supporting roller, and a position where the transfer roller contacts the conveying belt. Therefore, it may be unnecessary to provide, for example, rollers for pressing the recording medium against the conveying belt at a position between the transfer roller and the belt supporting roller. Accordingly, the number of components to be used in the image forming apparatus, and the size of the image forming apparatus may be reduced.

In some aspects of the image forming apparatus, the image forming apparatus may include a casing. A cartridge including at least the photosensitive drum and the developer may be removably installed in the casing opposite a conveying surface of the conveyor. A portion of the first guide member may be disposed between the cartridge and the conveying surface. Thus, the size of the image forming apparatus may be reduced. Further, the recording medium may be guided by the first guide member immediately before an image forming position on the conveying belt. Thus, the recording medium may be stably fed to the image forming position.

In other aspects, the image forming apparatus may include a casing. A cartridge including a case and at least one of the photosensitive drum and the developer may be removably installed in the casing of opposite to a conveying surface of the conveying belt. At least a part of the first guide member may be formed on the case of the cartridge. Thus, the image forming apparatus may be reduced in size. Further, the part of the first guide member may be replaced when the cartridge is replaced. Therefore, maintenance of the image forming apparatus may be readily performed, for example, when the first guide member is worn out by the friction with the recording medium.

In some aspects, the image forming apparatus may further include a casing and an image forming unit that includes a plurality of cartridges, each cartridge having at least the photosensitive drum and the developer, and a frame capable of removably supporting the plurality of the cartridges. The image forming unit may be removable relative to the casing of the image forming apparatus and the first guide member may be integrally formed with the frame. Thus, the first guide member may be removed from the casing of the image forming apparatus as the image forming unit is relative to the casing of the image forming apparatus. Therefore, clearing a recording medium jam occurring at an inner side of the first guide member may be readily performed.

In aspects, the image forming apparatus may further include a casing and a conveying unit including the feeding roller, the first guide member, and the conveying belt. The conveying unit may be removable relative to the casing of the image forming apparatus. Therefore, maintenance operations, such as an operation of clearing the recording medium jam or component exchanges, may be readily performed.

In aspects, the image forming apparatus may further include a supply unit, such as a sheet supply unit configured to hold a plurality of recording mediums and supply the recording mediums to the feeding roller and a discharge tray on which the recording mediums fed by the conveyor, which conveys the recording mediums fed from the feeding roller, is discharged. The supply unit, the conveyor and the discharge tray may be disposed so as to overlap in a single direction. With such a structure, a conveying path of the recording medium may be formed into a substantially "S" shape, so that the image forming apparatus may be made compact.

In other aspects, a cartridge may be removably installed in a casing of an image forming apparatus. The image forming apparatus may include a conveyor configured to convey a recording medium along a conveying surface thereof, a feeding roller configured to feed the recording medium toward the conveyor; a first guide member configured to guide the recording medium fed by the feeding roller onto the conveyor, the first guide member being disposed between the conveyor and the feeding roller. The image forming apparatus may form an image by transferring the visible image onto the recording medium fed on the conveyor. The cartridge may include a case and a photosensitive drum configured to carry an electrostatic latent image thereon, the photosensitive drum opposing the conveyor. The first guide member may have a guide portion over which a leading edge of the recording medium slides. The guide portion may be concavely formed. At least a part of the first guide member may be formed on the case of the cartridge. By forming a part of the first guide member on the case of the cartridge, the image forming apparatus may be made compact. Further, the part of the first guide member may be replaced when the cartridge is replaced. Therefore, maintenance of the image forming apparatus may be readily performed, for example, when the first guide member is worn out by the friction with the recording medium.

Illustrative Aspects

Illustrative aspects will be described with reference to FIGS. 1-7. FIG. 1 is a side sectional view of an overall configuration of a laser printer 1, as an image forming apparatus, according to an illustrative aspect. The laser printer 1 is a direct tandem color laser printer that does not employ an intermediate belt transfer system. The laser printer 1 includes four photosensitive drums 42 in association with four colors of black, cyan, magenta, and yellow. The laser printer 1 is provided in a main casing 2 with a conveying unit 4 that supplies and conveys a recording medium such as the sheet 3, and an image forming section 5 in which an image is formed on the sheet 3 fed by the conveying unit 4. In the following description, the right side in FIG. 1 is defined as a front side, and a side opposite to the front side (left side in FIG. 1) is defined as a rear side.

Figure 2:
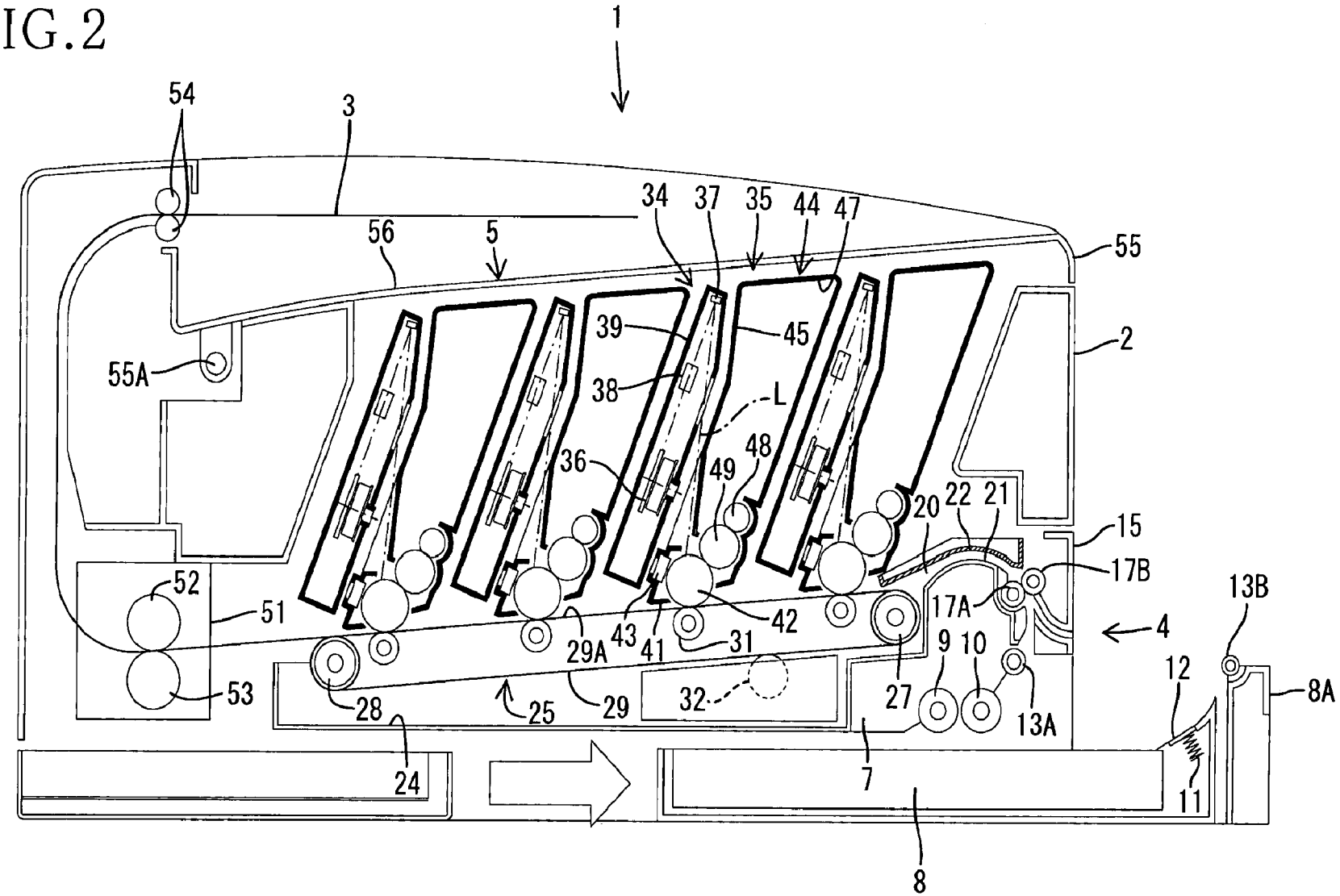
FIG. 2 is a sectional side view of the laser printer showing a state in which a sheet supply cassette is withdrawn from the printer according to illustrative aspects of the invention.

The conveying unit 4 is disposed at a lower part of the main casing 2 so as to be drawable or slidable toward the front side, relative to the main casing 2. The conveying unit 4 is provided with a unit frame 7. A sheet supply tray 8 that can accommodate a stack of sheets 3 to be supplied to the image forming section 5 is disposed below the unit frame 7 so as to be removably set relative to the unit fame 7. A front wall 8A provided at a front end of the sheet supply tray 8 is disposed at a lowermost part of a front face of the main casing 2. By pulling the front wall 8*a* toward the front side, the sheet supply tray 8 can be removed from the unit frame 7 and be drawn individually toward the front side of the main casing 2 as shown in FIG. 2.

Provided at the bottom of the sheet supply tray 8 is a sheet mount plate (not shown) capable of mounting thereon a stack of sheets 3. The sheet mount plate is pivotally supported about its rear end, so as to allow its front end to move in a vertical direction. A pickup roller 9 supported by the unit frame 7 is provided above a front end portion of the sheet supply tray 8, when the sheet supply tray 8 is set in the main casing 2. A sheet supply roller 10 supported by the unit frame 7 is disposed in front of the pickup roller 9. A separation pad 12 that is pressed against the sheet supply roller 10 by an urging force of a spring 11 is provided at a front portion of the sheet supply tray 8. A pair of sheet powder removing rollers 13A, 13B is disposed above and in front of the sheet supply roller 10. The sheet power removing roller 13A is disposed in the unit frame 7 and the other sheet power removing roller 13B is disposed in the sheet supply tray 8 at an upper rear end of the front wall 8A.

An uppermost sheet 3 on the sheet mount plate of the sheet supply tray 8 is pressed against the pickup roller 9 by the urging force of the sheet mount plate, and is conveyed toward a portion between the sheet supply roller 10 and the separation pad 12 in accordance with rotation of the pickup roller 9. As the uppermost sheet 3 is sandwiched between the sheet supply roller 10 and the separation pad 12 by the rotation of the sheet supply roller 10, each sheet 3 is fed one by one in an upward frontward direction. After sheet powders or fibers on the sheet 3 are removed by the sheet powder removing rollers 13A, 13B, the sheet 3 is fed to register rollers 17A, 17B, through a tray feed path 19 formed in an upward direction from the sheet powder removing rollers 13A, 13B.

Figure 3:
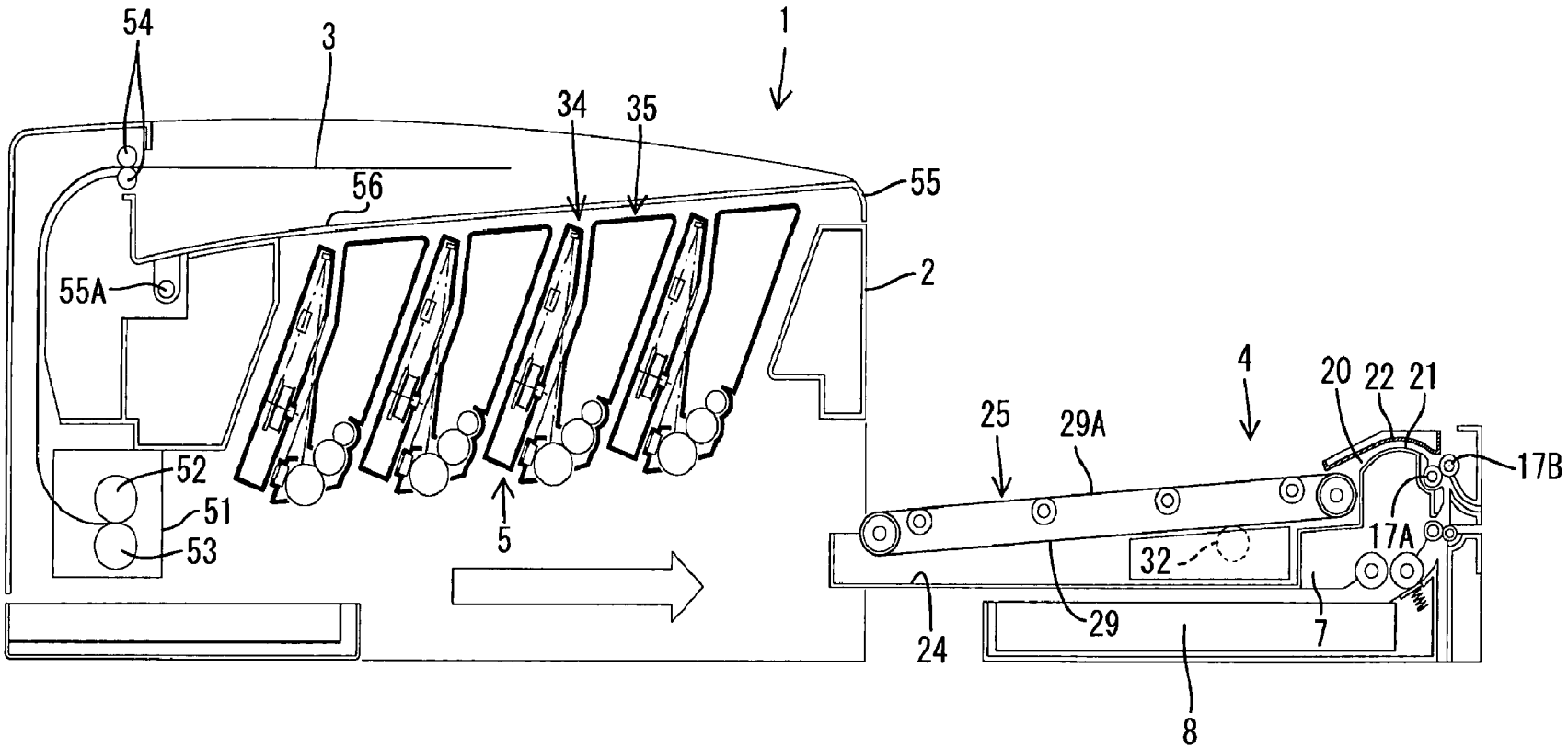
FIG. 3 is a sectional side view of the laser printer showing a state in which a conveying unit is withdrawn from the printer according to illustrative aspects of the invention.

Another front wall 15 is provided at the front end portion of the conveying unit 4, such that the front wall 15 is substantially flush with the front face of the main casing 2 and the front wall 8A of the sheet supply tray 8. As shown in FIG. 3, the conveying unit 4 is drawn out toward the front side, relative to the main casing 2, by pulling a handle (not shown) provided on the front wall 15 toward the front side. Disposed below the front wall 15 is a manual sheet feed slot 18A into which the sheet 3 is manually inserted. The register rollers 17A, 17B are disposed on the rear side of the front wall 15. A manual sheet feed path 18 defined from the manual sheet feed slot 18A and the tray feed path 19 defined from the sheet powder removing rollers 13A, 13B in the upward direction join immediately before the register rollers 17A, 17B. The register rollers 17A, 17B register, reduce or correct the skew of the sheet 3 fed through the manual sheet feed path 18 or the tray feed path 19, and then feed the sheet 3 to a conveying belt 29 through a sheet feed path 20. The sheet feed path 20 is defined between an inner chute 21 integrally formed with the frame unit 7 at an upper portion thereof and a chute 22 disposed above the inner chute 21 facing the inner chute 21. The sheet feed path 20 is formed so as to curve upward. The chute 22 and its peripheral structure are described in detail below.

Figure 5:
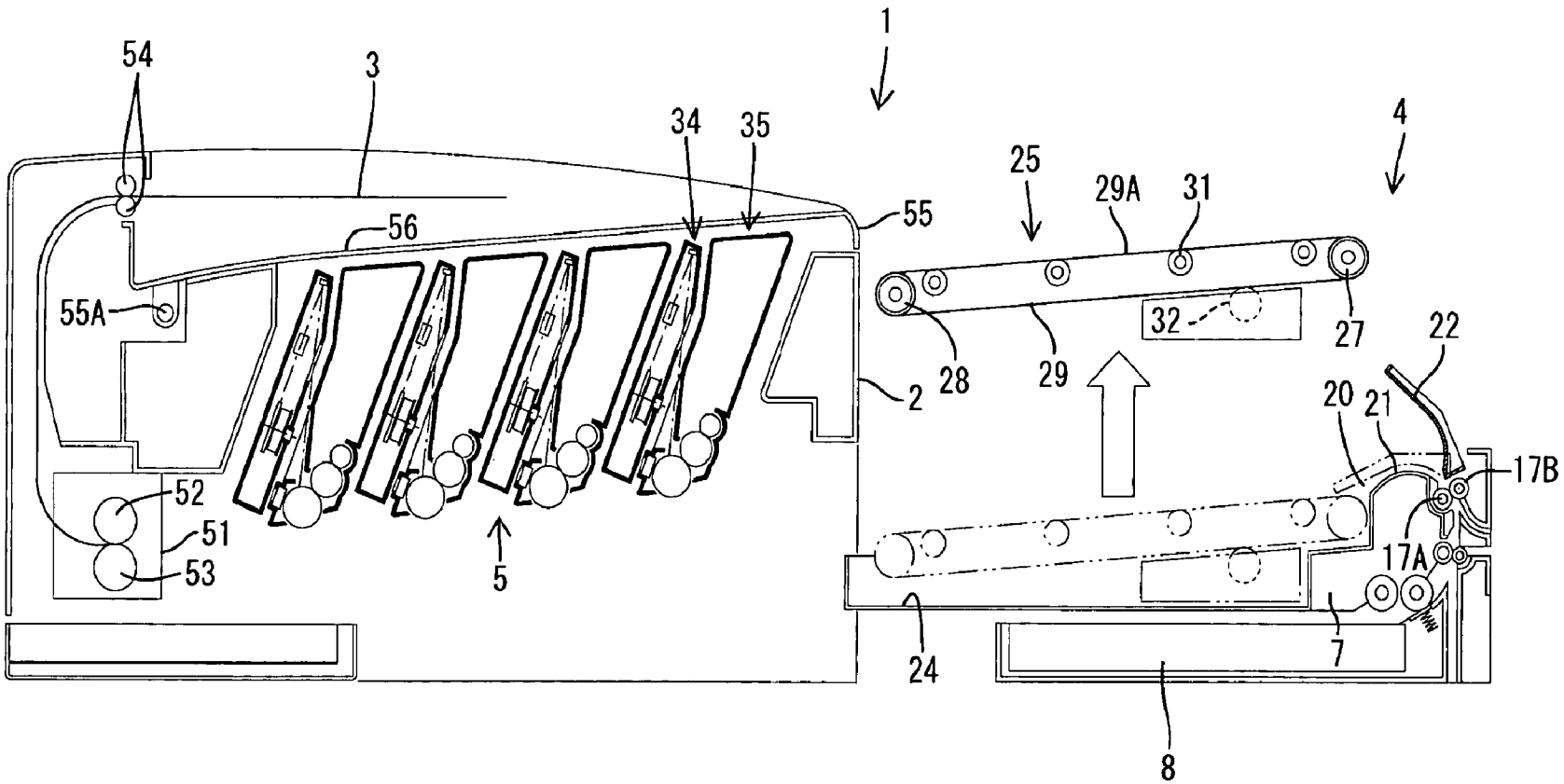
FIG. 5 is a sectional side view of the laser printer showing a state in which a belt unit is removed from the conveying unit according to illustrative aspects of the invention.
Figure 6:
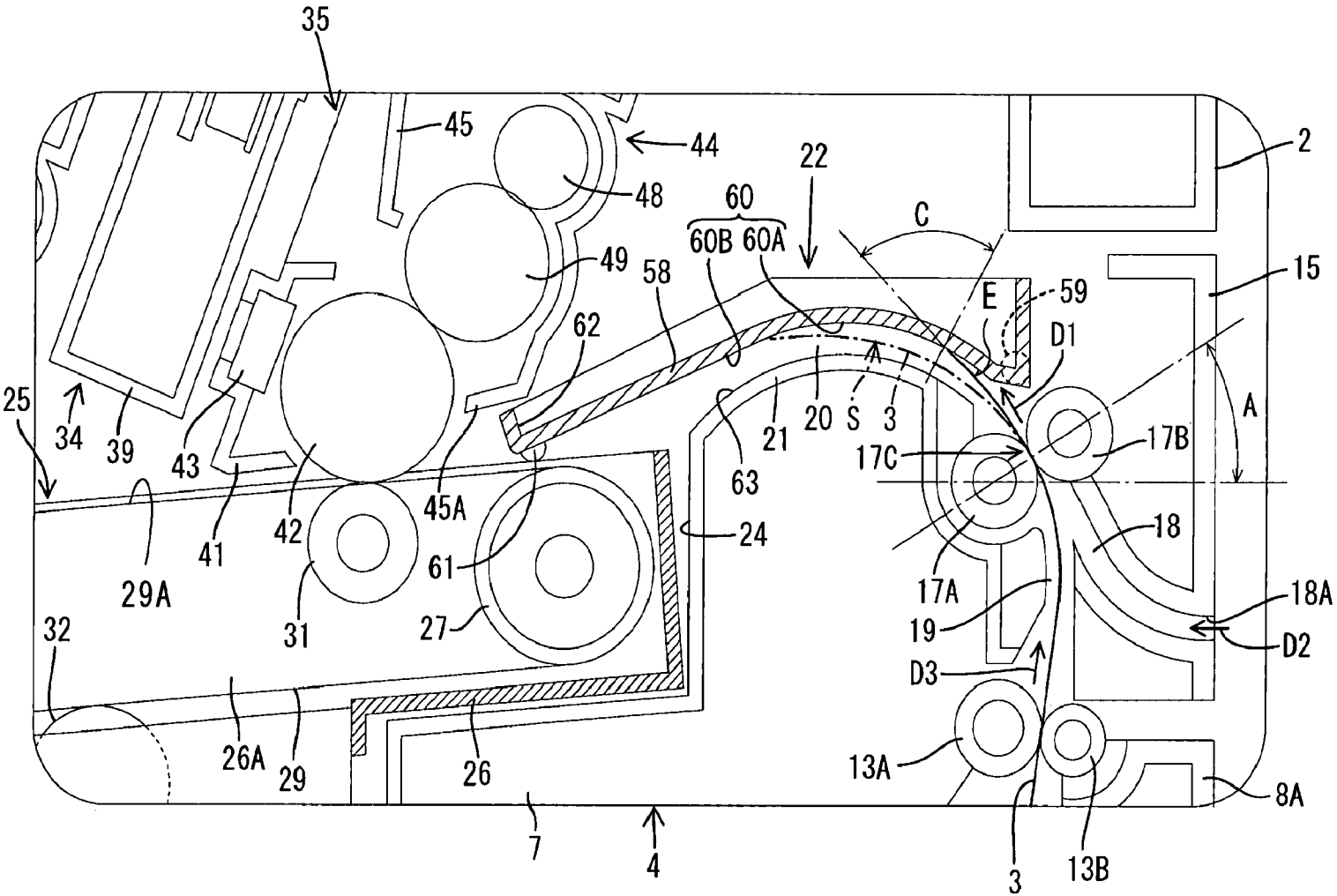
FIG. 6 is an enlarged sectional side view showing a periphery of a chute when a leading edge of a sheet is sliding over a guide surface according to illustrative aspects of the invention.

The unit frame 7 is provided with a belt unit installation portion 24 of substantially tray shape that is open upward behind the inner chute 21. A belt unit 25 is removably disposed in the belt unit installation portion 24. As shown in FIG. 6, the belt unit 25 is provided with a box-shaped belt frame 26 that is open upward (the belt frame 26 omitted in FIGS. 1-5). Components of the belt unit 25 are disposed inside the belt frame 26. The belt unit 25 includes a pair of belt supporting rollers 27, 28 disposed parallel to each other with a distance therebetween in the front-rear direction, and the conveying belt 29 looped around the belt supporting rollers 27, 28. The conveying belt 29 is circulated by the rotation of the rear-side belt supporting roller 28, which is driven by a motor (not shown). The front-side belt supporting roller 27 is disposed slightly higher than the rear-side belt supporting roller 28, such that a conveying surface 29A on the upper face of the conveying belt 29 where the sheet 3 is conveyed, is inclined downward at about 5 degrees with respect to a horizontal direction. Four transfer rollers 31 are disposed on an inner side of the conveying belt 29 in line along the front-rear direction with a predetermined distance between the adjacent transfer rollers 31, so as to face the relevant photosensitive drums 42. A cleaning roller 32 for cleaning a residual toner attached to the conveying belt 29 is disposed below the conveying belt 29. The sheet 3 fed by the register rollers 17A, 17B passes through the sheet feed path 20 and contacts a front portion of the conveying surface 29A of the conveying belt 29, where the sheet 3 is electrostatically attracted and conveyed rearward in accordance with the circular movement of the conveying belt 29.

The image forming section 5 is disposed in the main casing 2 above the belt unit 25. The image forming section 5 includes four scanner units 34, as exposure devices, and four process cartridges 35 for forming an image corresponding to magenta, yellow, cyan, and black colors. The process cartridges 35 and the scanner units 34 are alternately disposed in line along the front-rear direction. Each scanner unit 34 includes a polygon mirror 36 that sequentially deflects a laser beam L emitted from a laser diode (not shown) while the laser beam L strikes a surface of the polygon mirror 36, a reflecting mirror 37 that directs the laser beam L deflected from the polygon mirror 36 toward the photosensitive drum 42 of the process cartridge 35, and an fθ lens 38 disposed in a path of the laser beam L. The polygon mirror 36, the reflecting mirror 37, and the fθ lens 38 are disposed in a scanner case 39. The scanner case 39 is substantially boxed shape. Each scanner case 39 is disposed at an angle, that is, about 20 degrees toward the front side, with respect to a vertical direction.

Figure 4:
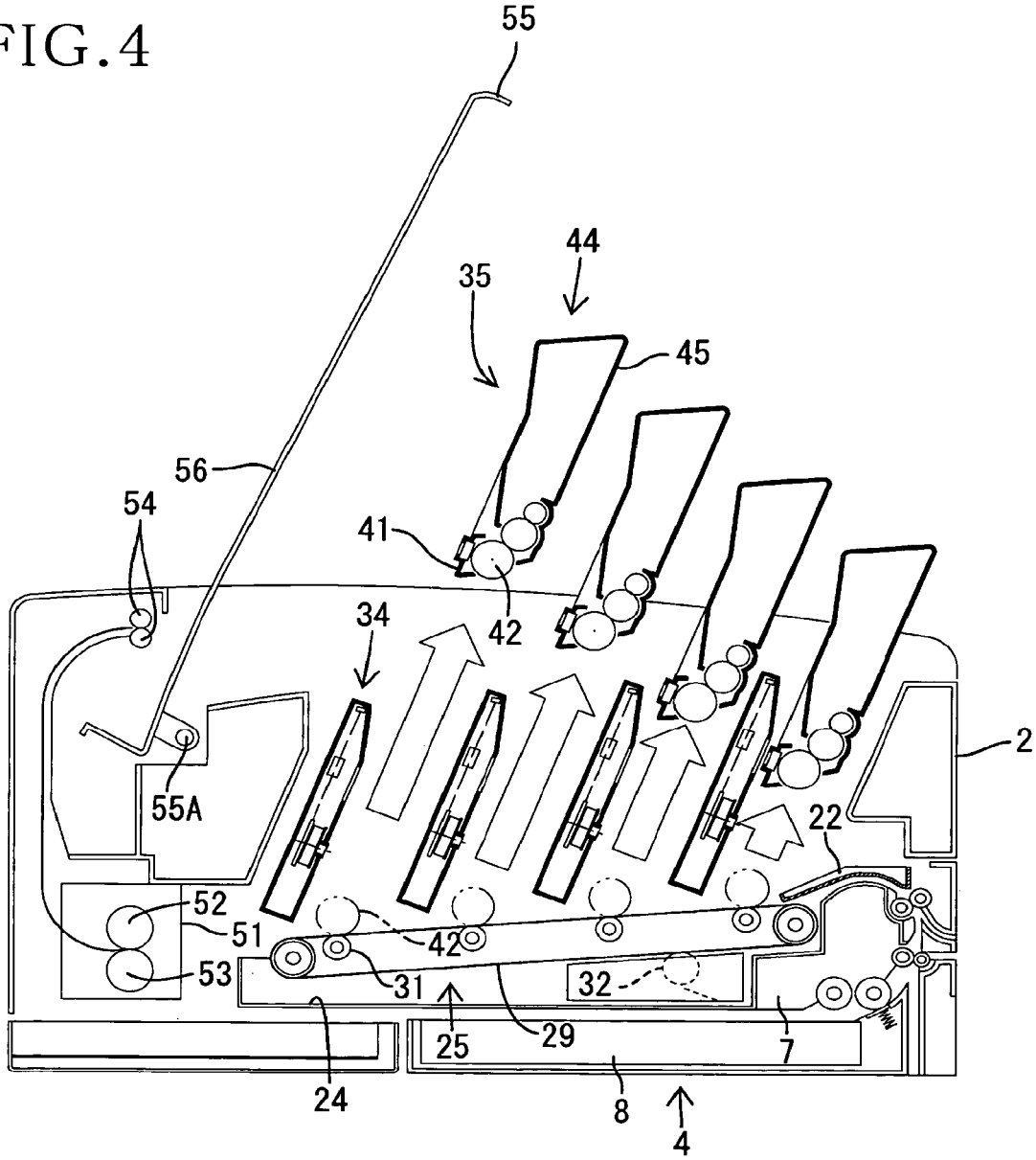
FIG. 4 is a sectional side view of the laser printer showing a state in which a cover is open according to illustrative aspects of the invention.

Each process cartridge 35 includes the photosensitive drum 42 having a photosensitive layer on its surface and a scorotron charger 43 for uniformly charging the surface of the photosensitive drum 42. The photosensitive drum 42 is rotatably disposed at a lower part of a cartridge frame 41. The scorotron charger 43 is disposed near the photosensitive drum 42. A developing cartridge 44, as a developer, is removably installed in each cartridge frame 41. Each developing cartridge 44 includes a case 45 of a box shape that is open downward. Each case 45 is disposed in a slanted manner toward the front side, with respect to a vertical direction. A toner chamber 47 for containing toner, as a developing agent, of one color of magenta, cyan, yellow, and black, is formed at an upper portion of the case 45. An agitator (not shown) that agitates the toner in the toner chamber 47 is rotatably provided in the toner chamber 47. Disposed in the case 45 below the toner chamber 47 is a supply roller 48, a developing roller 49, and a layer-thickness regulating blade (not shown). The process cartridge 35 is removably installed in the main casing 2. As shown in FIG. 4, the process cartridge 35 is removed from the main casing 2 along a front upward direction and installed into the main casing 2 along the opposite direction (rearward downward direction).

Toner discharged from the toner chamber 47 is supplied to the developing roller 49 by rotation of the supply roller 48. At this time, toner is positively charged by the friction between the supply roller 48 and the developing roller 49. Toner supplied onto the developing roller 49 enters between an end of the layer-thickness regulating blade and the developing roller 49, in accordance with the rotation of the developing roller 49, and is carried on the developing roller 49 as a thin layer whose thickness has been regulated. While the photosensitive drum 42 rotates, the surface of the photosensitive drum 42 is uniformly and positively charged by the scorotron charger 43. Then, the laser beam L from the scanner unit 34 scans across the surface of the photosensitive drum 42 at high speed, thereby forming, on the surface of the photosensitive drum 42, an electrostatic latent image corresponding to an image to be formed on the sheet 3.

Thereafter, toner, which is carried on the developing roller 49 and positively charged, makes contact with the photosensitive drum 42 in accordance with the rotation of the developing roller 49, and is supplied to the electrostatic latent image formed on the surface of the photosensitive drum 42, making the electrostatic latent image visible. Thus, a toner image is formed on the photosensitive drum 28 by reverse developing.

Then, the toner image carried on the photosensitive drums 42 is sequentially transferred onto the sheet 3 by a transfer bias applied to the transfer rollers 31 while the sheet 3 passes through transfer positions between the photosensitive drums 42 and the transfer rollers 31. Thereafter, the sheet 3 is fed to a fixing unit 51.

The fixing unit 51 is provided in the main casing 2 behind the conveying belt 29. The fixing unit 51 includes a heat roller 52 and a pressure roller 53 that are disposed to face each other. The toner image transferred on the sheet 3 is thermally fixed by the fixing unit 51. Then, the sheet 3 having the toner image fixed thereon is fed, while making a U-turn, to discharge rollers 54 disposed at an upper portion of the main casing 2. A cover 55 that pivots about a hinge portion 55A to open or close the cover 55 is provided on an upper portion of the main casing 2. An upper face of the cover 55 functions as a discharge tray 56 on which the sheet 3 discharged by the discharge rollers 54 is stacked after the image formation is complete. The process cartridges 35 can be replaced as the cover 55 is open, as shown in FIG. 4.

In the laser printer 1, the sheet supply tray 8, the belt unit 25, the image forming section 5, and the discharge tray 56 formed on the upper face of the main casing 2 are disposed in a stacked manner in the vertical direction in the main casing 2 in this order from below. The printer 1 is provided with a substantially S-shaped sheet conveying path in which the sheet 3 fed frontward from the sheet supply tray 8 in the sheet feeding direction makes a U-turn to convey the sheet 3 rearward along the conveying belt 29 and again makes a U-turn at a rear portion of the printer 1 to feed the sheet 3 to the discharge tray 56.

Figure 7:
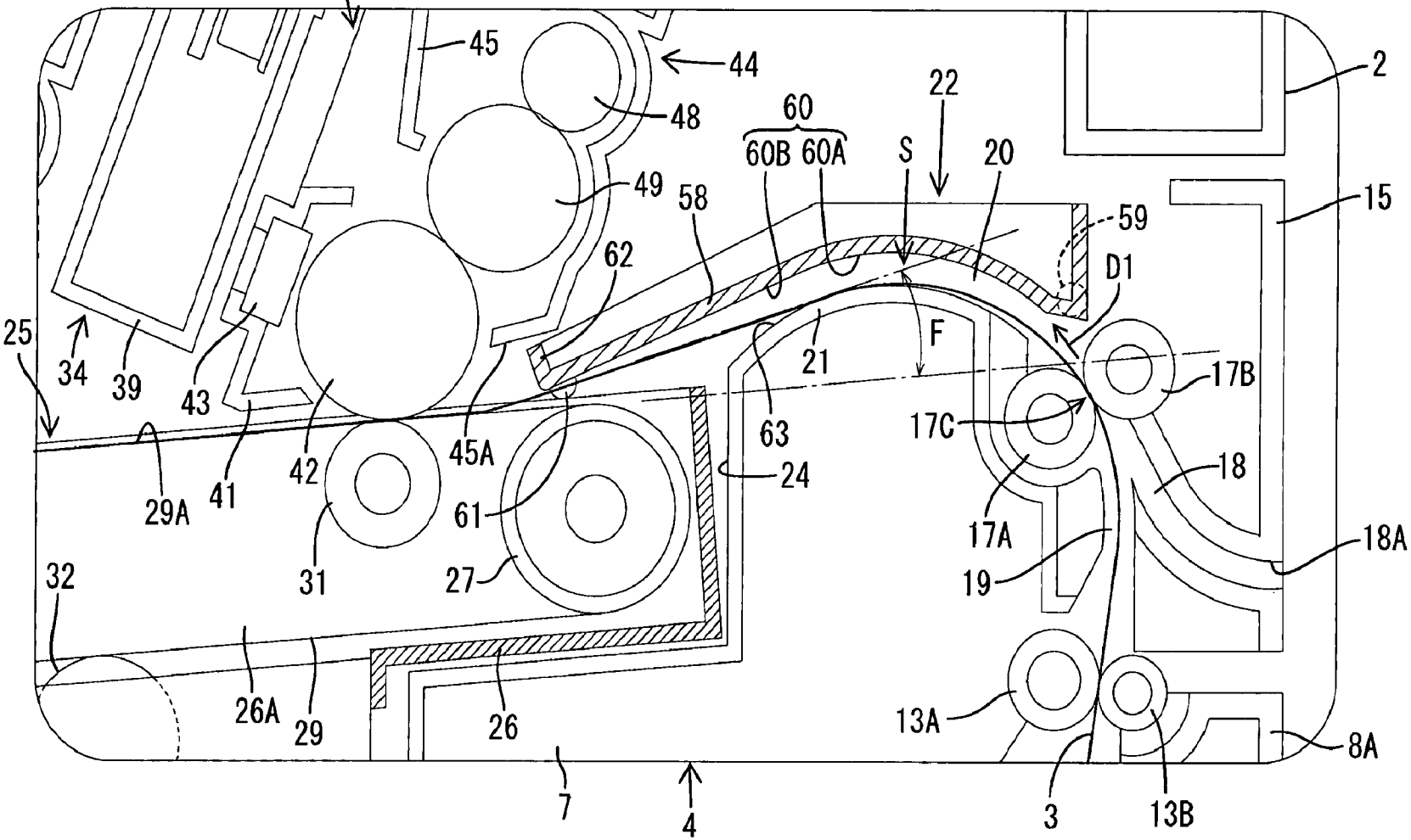
FIG. 7 is an enlarged sectional side view showing the periphery of the chute when the sheet makes contact with a conveying belt according to illustrative aspects of the invention.

With reference to FIGS. 6 and 7, the chute 22 of the conveying unit 4 and the periphery of the chute 22 will be described in detail below. The register rollers 17A, 17B have substantially the same diameter. As shown in FIG. 7, a nip position 17C between the register rollers 17A, 17B is placed near an extension of the conveying surface 29A of the conveying belt 29. The front-side register roller 17B is positioned slightly higher than the rear-side register roller 17A. As shown in FIG. 6, an angle A formed by the horizontal line and a line connecting the axes of the register rollers 17A, 17B are set within the range of 0° to 90° ($0° < A < 90°$). More specifically, a sheet feeding direction D1 (perpendicular to the line connecting the axes of the register rollers 17A, 17B) in which the sheet 3 is fed by the register rollers 17A, 17B is provided at an angle in an upward slanting direction toward the conveying belt 29 with respect to a vertical direction. More specifically, the angle formed between a vertical line and the sheet feeding direction D1 is set to about 30 degrees. The manual sheet feed path 18 is substantially horizontal at a position near the manual sheet feed slot 18A. In other words, a sheet insertion direction D2 in which the sheet 3 is inserted from the manual sheet feed slot 18A to the manual sheet feed path 18 is substantially horizontal in a rearward direction. The manual sheet feed path 18 curves in the upward rearward direction along the sheet feeding direction, so as to approach the sheet feeding direction DI of the register rollers 17A, 17B. A sheet feeding direction D3 (perpendicular to a line connecting the axes of the sheet power removing rollers 13A, 13B) in which the sheet 3 is fed along the tray feed path 19 by the sheet powder removing rollers 13A, 13B, is provided at an angle in an upward slanting direction toward the front side, with respect to the vertical direction. More specifically, the angle formed between a vertical line and the sheet feeding direction D3 may be set to about 10 degrees. The tray feed path 19 slightly curves in the upward rearward direction at a downstream side thereof with respect to the sheet feeding direction, so as to approach the sheet feeding direction D1 of the register rollers 17A, 17B. The sheet feeding direction D1 of the register rollers 17A, 17B is provided between the sheet insertion direction D2 to the manual sheet feed path 18 and the sheet feeding direction D3 of the sheet powder removing rollers 13A, 13B. Therefore, in either case where the sheet 3 takes the manual sheet feed path 18 or the tray feed path 19, the curvature of the sheet 3 can be restricted. With such a structure, even when the printer 1 is downsized, the curvature of the sheet 3 in the manual sheet feed path 18 and the tray feed path 19 can be restricted, so that loads applied to the sheet 3 or a sheet conveying device, such as the register rollers 17A, 17B, can be reduced.

The sheet feeding direction DI of the register rollers 17A, 17B is disposed between a sheet feeding direction on the conveying surface 29A, which may be provided at an angle of about 5 degrees with respect to a horizontal line, of the conveying belt 29 and its perpendicular direction. If the sheet feeding direction D1 of the register rollers 17A, 17B is set to the direction perpendicular to the conveying surface 29A, the curvature of the sheet 3 in the sheet feed path 20 becomes greater. If the sheet feeding direction D1 of the register rollers 17A, 17B is set to the direction parallel to the conveying surface 29A, the curvature of the sheet feed path 20 increase causing the sheet 3 to experience curve and slack in the sheet feed path 20 by a predetermined degree as described below. In these aspects, the curvature of the sheet 3 in the sheet feed path 20 can be made smaller, as compared with the cases where the sheet feeding direction D1 is disposed parallel or perpendicular to the conveying surface 29A. With such a structure, even when the printer 1 is downsized, the curvature of the sheet 3 in the sheet feed path 20 can be restricted, so that loads applied to the sheet 3 or the sheet conveying device, such as the register rollers 17A, 17B and the conveying belt 29, can be reduced.

The chute 22 is formed of synthetic resin and provided with a plate portion 58 facing the sheet feed path 20. The plate portion 58 has a width (perpendicular to the front-rear direction) substantially the same as the belt frame 26 of the belt unit 25. The width of the plate portion 58 is set larger than a width of a maximum sheet that the printer 1 can handle. Formed at lower front ends of the chute 22 on the right and left sides thereof is a pair of shafts 59. The shafts 59 are supported by shaft receiving portions (not shown) formed on the unit frame 7, such that the chute 22 pivots about the shafts 59. Formed on a lower surface of the plate portion 58 is a guide surface 60 where the leading edge of the sheet 3 fed by the register rollers 17A, 17B can slide. The guide surface 60 may be concavely formed such that the guide surface 60 faces downward and rearward at the front portion thereof, downward at a central portion thereof, and downward and frontward at the rear portion thereof. The guide surface 60 includes an arc surface 60A of a substantially front half portion (on the upstream side with respect to the sheet feeding direction) and a flat surface 60B of a substantially rear half portion (on the downstream side).

A positioning protrusion 61 protrudes downward from each of the right and left downstream-ends of the lower surface of the plate portion 58. The downstream end of the chute 22 is positioned by making lower ends of the positioning protrusions 61 contact the upper edge of side walls 26A of the belt frame 26. A reinforcing edge 62 is provided at the downstream end, with respect to the sheet feeding direction, of the plate portion 58 on a surface opposite to the guide surface 60 across the width of printer 1 perpendicular the front-rear direction. The reinforcing edge 62 is provided substantially perpendicular to the plate portion 58. Thus, the strength of the chute 22 at its downstream end can be ensured.

A lower end 45A of the case 45 of the process cartridge 35 is disposed above the conveying belt 29 so as to face the conveying surface 29A. The downstream end of the chute 22 is disposed between the lower end 45A of the case 45 and the conveying surface 29A. The movement of the downstream end of the chute 22 in the upward direction is restricted by the lower end 45A of the case 45.

The transfer roller 31 for transferring the toner image of the first color is disposed downstream of the front-side belt supporting roller 27 disposed closer to the chute 22. The downstream end of the chute 22 is disposed downstream of a supporting position of the belt supporting roller 27 in the conveying surface 29A, and slightly away from the conveying surface 29A. The leading edge of the sheet 3, which is fed along the chute 22, is guided on the conveying surface 29A between the supporting position of the belt supporting roller 27 in the conveying surface 29A and a contact position between the transfer roller 31 and the conveying surface 29A. The sheet 3 fed along the chute 22 may contact the conveying surface 29A from above at an angle of between 5 and 45 degrees, preferably between 5 and 30 degrees. The velocity Vr of the register rollers 17A, 17B conveying the sheet 3 is faster than the velocity Vb of the conveying belt 29 conveying the sheet 3 (Vr>Vb).

The inner chute 21 is integrally formed on the front upper face of the unit frame 7. The inner chute 21 is structured such that the sheet 3 can slide over the inner chute 21. The inner chute 21 has an upwardly curving guide surface 63 that faces the guide surface 60. The upwardly curving guide surface 63 is convexly formed such that the guide surface 63 faces upward and frontward at a front portion thereof, upward at a central portion thereof and upward and rearward at a rear portion thereof. The upwardly curving or convex guide surface 63 faces the arc surface 60A of the guide surface 60 with a certain distance therebetween at an upstream side of the guide surface 63 and faces the flat surface 60B at a downstream side of the guide surface 63. The distance between the guide surface 63 and the flat surface 60B is set greater than that between the guide surface 63 and the arc surface 60A. The upwardly curving guide surface 63 terminates at a position to face a substantially central portion of the flat surface 60B.

As the sheet 3 is fed by the register rollers 17A, 17B, the leading edge of the sheet 3 first contacts at a position near the upstream end of the guide surface 60, with respect to the sheet feeding direction. As the sheet 3 is further fed by the register rollers 17A, 17B, the sheet 3 moves in the sheet feeding direction while sliding over the guide surface 60. In accordance with the movement of the sheet 3, the sheet 3 gradually changes in direction, such that the leading edge of the sheet 3 is gradually directed toward the conveying belt 29. In some aspects, a contact angle E, as shown in FIG. 6, of the leading edge of the sheet 3 relative to the guide surface 60 is always set equal to or less than 45 degrees. The contact angle E is obtained by the equation, E=90°−C where C is an angle, as shown in FIG. 6, between the contact point where the leading edge of the sheet 3 contacts the guide surface 60 and the normal to the guide surface 60 at the contact point. If the leading edge of the sheet 3 contacts the guide surface 60 at a greater angle, that is, the angle E is greater, a greater load is applied to the sheet 3 and the leading edge of the sheet 3 may possibly be damaged. In these aspects, the sheet 3 contacts the guide surface 60 at an angle of less than or equal to 45 degrees, so that the loads applied to the sheet 3 can be reduced.

As the sheet 3 is further fed in the sheet feeding direction while sliding over the guide surface 60, a middle portion of the sheet 3 between its leading edge and the nip position 17C, which is between the register rollers 17A, 17B, gradually curves upwardly. A space S is defined, to account for the stiffness of the sheet 3, between the guide surface 60 and the middle portion of the sheet 3 curving upwardly, as shown in FIG. 6 by a dot-dash line. While the leading edge of the sheet 3 moves along the arc surface 60A and then the flat surface 60B, the middle portion of the sheet 3 come in contact with the upwardly curving guide surface 63.

As the leading edge of the sheet 3 passes the downstream end of the guide surface 60 in the sheet feeding direction and comes into contact with the conveying surface 29A of the conveying belt 29 the sheet 3 is electrostatically attracted to the conveying surface 29A. In accordance with the movement of the conveying surface 29A, the sheet 3 is conveyed rearward along the sheet feeding direction. The sheet 3 fed along the chute 22 contacts the conveying surface 29A at an angle from above. More specifically, as shown in FIG. 7, an angle F between the conveying surface 29A and the direction of the sheet 3 fed from the chute 22 is between 5 and 45 degrees (5°<F<45°). Thus, the sheet feeding force from the register rollers 17A, 17B acts on the conveying belt 29 such that the sheet 3 is pressed against the conveying surface 29A of the conveying belt 29. Thus, the sheet 3 can make close contact with the conveying surface 29A of the conveying belt 29 without being lifted off the conveying surface 29A. The leading edge of the sheet 3 contacts a substantially flat portion of the conveying surface 29A downstream of a curved portion, for example, at the supporting portion of the belt supporting roller 27 at the conveying surface 29A. Thus, the sheet 3 can be fed stably.

The leading edge of the sheet 3 attracted to the conveying belt 29 is then held between the photosensitive drum 42 and the transfer roller 31 of the first color, just before the leading edge of the sheet 3, and the toner image of the first color is transferred on the sheet 3 while the sheet 3 passes between the photosensitive drum 42 and the transfer roller 31. While the sheet 3 is fed in the sheet feeding direction in accordance with the movement of the conveying belt 29, toner images of the respective colors are transferred on the sheet 3 with the relevant photosensitive drums 42 and the transfer rollers 31. Because the velocity Vr of the register rollers 17A, 17B conveying the sheet 3 is faster than the velocity Vb of the conveying belt 29 conveying the sheet 3, the sheet 3 gradually is provided with slack between the conveying belt 29 and the register rollers 17A, 17B. The slack in the sheet 3 is allowed in the space S formed between the sheet 3 and the guide surface 60. At this time, the sheet 3 takes a curved position due to the chute 22 and the inner chute 21. Therefore, loads applied to the sheet 3 or the sheet conveying device, such as the register rollers 17A, 17B, can be reduced as compared with a case where the sheet 3 is slackened from a flat state.

As a trailing edge of the sheet 3 passes through the nip portion 17C between the register rollers 17A, 17B, the trailing edge of the sheet 3 may move or vibrate in the thickness direction of the sheet 3. In these aspects, the movement or vibration of the sheet 3 can be reduced as the sheet 3 contacts the chute 22 or the inner chute 21, which are disposed on both sides of the upper and lower surfaces of the sheet 3, respectively. Thus, the color registration problems may be prevented that occur due to the vibration of the trailing edge of the sheet 3 transmitted up to the transfer position between the photosensitive drum 42 and the transfer roller 31.

In the laser printer 1, when a sheet jam is cleared or the conveying belt 29 is exchanged, the conveying unit 4 is removed from the laser printer 1 toward the front side of the main casing 2, as shown in FIG. 3. Thus, the sheet jam may be cleared if the sheet jam occurs on the conveying belt 29 or at the periphery of the fixing unit 51. When the sheet jam occurs in the sheet feed path 20 or near the register rollers 17A, 17B, the rear end of the chute 22 is pivotally moved up, as shown in FIG. 5, to release or open the sheet feed path 20. Thus, the sheet jam can be cleared readily. When the belt unit 25 is exchanged, the chute 22 is pivotally moved up, as described above. Then, the belt unit 25 is moved up to remove the belt unit 25 from the belt unit installation portion 24. When the sheet jam occurs near the sheet supply roller 10 or the sheet powder removing rollers 13A, 13B, the sheet supply tray 8 is drawn relative to the unit frame 7 toward the front side, as shown in FIG. 2. Thus, the sheet jam, which occurs near the sheet supply roller 10 or the sheet powder removing rollers 13A, 13B, can be cleared.

According to some aspects, the chute 22 is provided with the guide surface 60 over which the leading edge of the sheet 3 slides. The guide surface 60 is concavely formed such that the sheet 3 is turned while being fed in the sheet feeding direction. With such a structure, the sheet 3 fed by the register rollers 17A, 17B is conveyed in the sheet feeding direction while its leading edge slides over the guide surface 60, a portion of the sheet 3 between its leading edge and the nip position 17C between the register rollers 17A, 17B gradually curves and the space S is defined between the sheet 3 and the guide surface 60, due to the stiffness of the sheet 3. Thus, the sheet 3 can smoothly curve. In the case where the velocity Vr of the register rollers 17A, 17B conveying sheet 3 is faster than the velocity Vb of the conveying belt conveying 29 the sheet 3, the slack in the sheet 3 is allowed in the space S defined between the sheet 3 and the guide surface 60. Thus, the sheet 3 may be curved and accordingly, the sheet 3 can be stably fed without applying loads to the sheet conveying device or the sheet 3 itself.

The sheet 3 fed from the chute 22 contacts the conveying surface 29A of the conveying belt 29 at an angle of between 5 and 45 degrees from the above. If the sheet 3 fed from the chute 22 contacts the conveying surface 29A substantially parallel with the conveying surface 29A, the sheet 3 may be lifted from the conveying surface 29A or may not make close contact with the conveying surface 29A. However, in these aspects, the sheet 3 can be pressed against the conveying surface 29A from above and make close contact with the conveying surface 29A.

The velocity Vr of the register rollers 17A, 17B conveying the sheet 3 is set faster than the velocity Vb of the conveying belt 29 (Vr>Vb) conveying the sheet 3. Therefore, poor image formation can be prevented due to the unstable sheet feeding caused by, for example, the sheet pulling between the conveying belt 29 and the register rollers 17A, 17B.

The register rollers 17A, 17B that reduce or correct the skew of the sheet 3 function as rollers for feeding the sheet 3 toward the conveying belt 29. Thus, a structure of the printer 1 can be simplified without additionally providing register rollers in the printer 1.

The contact angle of the leading edge of the sheet 3 to the guide surface 60 of the chute 22 is always set to equal to or less than 45 degrees. When the leading edge of the sheet 3 contacts the guide surface 60 at a greater contact angle, loads applied to the sheet 3 become greater. Accordingly, the leading edge of the sheet 3 may be damaged. In this aspect, the leading edge of the sheet 3 contacts the guide surface 60 at an angle of less than or equal to 45 degrees. Thus, damages to the sheet 3 can be prevented.

In the printer 1, the inner chute 21 is provided that forms a sheet feed path between the inner chute 21 and the chute 22. The inner chute 21 is provided with the upwardly curving guide surface 63 that faces the guide surface 60, so that the sheet 3 can be smoothly guided. If the sheet 3 is vibrated in the direction of its thickness, the vibration can be reduced.

The chute 22 is movable so as to release or open the sheet feed path 20. Therefore, the sheet jam occurred at an inner side of the chute 22 can be cleared readily.

The sheet feeding direction D1 of the register rollers 17A, 17B is directed between the sheet feeding direction on the conveying surface 29A and its perpendicular direction. Thus, the curvature of the sheet 3 in the sheet feed path 20 can be restricted even when the printer 1 is reduced in size.

The chute 22 is structured such that the leading edge of the sheet 3 contacts the conveying belt 29 downstream of the supporting position, in the conveying surface 29A, of the belt supporting roller 27, which is disposed closer to the chute 22. The leading edge of the sheet 3, which is fed along the chute 22, slightly vibrates. If the leading edge of the sheet 3 fed along the chute 22 contacts the conveying belt 29 where the belt supporting roller 27 is supported, a contact position of the leading edge of the sheet 3 to the conveying belt 29 may be shifted greatly due to the vibrations of the leading edge of the sheet 3, and because the supporting position of the belt supporting roller 27 in the conveying surface 29A is relatively uneven. Consequently, a sheet feeding accuracy becomes poor. In this embodiment, the leading edge of the sheet 3 contacts the substantially flat portion of the conveying surface 29A, other than the supporting position of the belt supporting roller 27 in the conveying belt 29. Therefore, a favorable sheet feeding accuracy can be maintained while reducing the influence of the vibrations of the leading edge of the sheet 3.

The reinforcing edge 62 is formed at the downstream end of the chute 22 on a surface opposite to the guide surface 60. Thus, the strength of the chute 22 at its end can be improved.

In the laser printer 1 according to the some aspects, the sheet feeding accuracy can be maintained with the conveying unit 4 provided with the chute 22 having the guide surface 60. Thus, a high-quality image can be formed.

The transfer roller 31 is disposed downstream of the belt supporting roller 27, which is disposed closer to the chute 22. The chute 22 is structured such that the leading edge of the sheet 3 contacts the conveying belt 29 between the transfer roller 31 and the supporting position of the belt supporting roller 27 in the conveying belt 29. Therefore, it is unnecessary to provide, for example, rollers for pressing the sheet 3 against the conveying belt 29 at a position between the transfer roller 31 and the belt supporting roller 27. Accordingly, in some aspects the number of components to be used in the laser printer 1, as well as the size of the printer 1 can be reduced.

The chute 22 is disposed such that a part thereof is interposed between the process cartridge 35 and the conveying belt 29. Thus, in some aspects the size of the laser printer 1 can be reduced. Further, the sheet 3 can be guided by the chute 22 immediately before the transfer position on the conveying belt 29. Thus, the sheet 3 can be stably fed to the transfer position.

The conveying unit 4 including the register rollers 17A, 17B, the chute 22 and the conveying belt 29 is movably provided relative to the main casing 2. Accordingly, maintenance operations such as sheet jam clearing operation or components exchanges can be readily performed.

The sheet conveying path is formed in a substantially "S" shape in a side view, so that the printer 1 can be made compact.

The sheet feeding accuracy can be maintained by applying aspect to a direct tandem color laser printer provided with the developing cartridges 44 and the photosensitive drums 42 according to colors. Therefore, the high-quality color image can be formed.

Illustrative aspects will be described in detail below with reference to FIG. 8. A main difference between the first and second embodiments is a chute. It should be noted that similar reference numerals denote similar components with respect to the illustrative aspects described above and will be omitted for brevity.

A chute 66 is provided with a plate portion 66 formed along the sheet feed path 20. Formed on an undersurface of the plate portion 66 is a guide surface 67 where the leading edge of the sheet 3 fed by the register rollers 17A, 17B slides. The guide surface 67 is concavely formed, similar to the guide surface 60 according to the illustrative aspects described above, such that the sheet 3 gradually changes in direction while being fed in the sheet feeding direction. The guide surface 67 includes an arc surface 67A of a substantially front half portion (on the upstream side in the sheet feeding direction) and a flat surface 67B of a substantially rear half portion (on the downstream side). In FIG. 8, a point G on the plate portion 66 shows a position where the leading edge of the sheet 3 fed by the register rollers 17A, 17B first contacts the plate portion 66. The point G corresponds with an upstream end of the guide surface 67. An extended guide surface 68 extends from the upstream end of the guide surface 67 toward the upstream side with respect to the sheet feeding direction, near the nip position 17C between the register rollers 17A, 17B. The extended guide surface 68 is provided to face rearward and downward and smoothly connect to the guide surface 67. The extended guide surface 68 is formed such that a portion of the sheet 3 other than its leading edge can slide over the extended guide surface 68.

In the chute 65, the extended guide surface 68 that extends upstream of the guide surface 67 where the leading edge of the sheet 3 contacts, is formed near the register rollers 17A, 17B. Therefore, vibrations of the trailing edge of the sheet 3 caused, for example, when the trailing edge of the sheet 3 passes the register rollers 17A, 17B, can be prevented. Accordingly, in some aspects the sheet 3 can be stably fed and the quality of an image to be printed or recorded can be enhanced.

Figure 8:
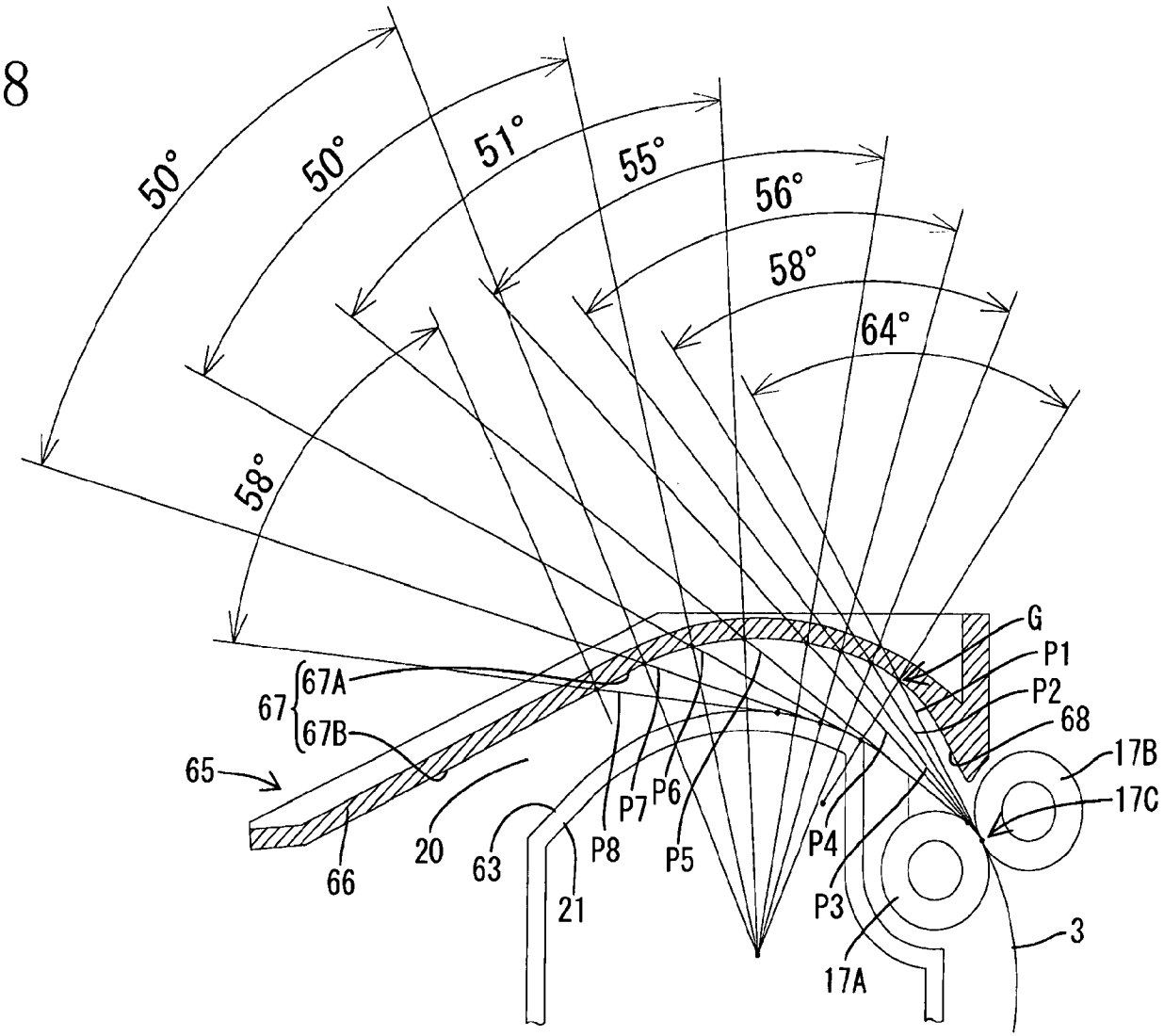
FIG. 8 is an enlarged sectional side view showing a periphery of a chute according to another illustrative aspect.

In FIG. 8, a line P1 is a line passing through the point G where the leading edge of the sheet 3 first contacts the guide surface 67. Lines P2 to P8 show sequential movements of the sheet 3 in the sheet feeding direction from the point G. Lines normal to the guide surface 67 at contact points of the leading edge of the sheet 3 to the guide surface 67 are also shown in FIG. 8. As described above, the contact angle E of the leading edge of the sheet 3 to the guide surface 67 is obtained by the equation, E=90°−C where C is an angle between the contact point where the leading edge of the sheet 3 contacts the guide surface 67 and the normal to the guide surface 67 at the contact point. When the sheet 3 is in a position represented by the line P1, the angle E is 26 degrees (E=90°−64°). Similarly, when the sheet 3 is in positions represented by the lines P2 to P8, the contact angles E are 32°, 34°, 35°, 39°, 40°, 40°, and 32°, respectively. The sheet positions represented by the lines P1 to P8 are given as examples, and vary according to the stiffness of the sheet 3. If the sheet 3 is not stiff but is flexible, the sheet 3 curves more outward, so that values of the contact angles E become smaller.

In further aspects, the contact angle E of the leading edge of the sheet 3 to the guide surface 67 is set to less than or equal to 45 degrees (less than or equal to 40 degrees in the above calculations when the sheet 3 is in the positions represented by the lines P1 to P8). Because the sheet 3 contacts the guide surface 67 at an angle equal to or less than 45 degrees, loads applied to the sheet 3 can be restricted. It is most difficult to turn the sheet 3 at the position where the sheet 3 first makes contact with the chute 65. However, the contact angle E of the leading edge of the sheet 3 to the guide surface 67 at the point G is set to be relatively small, so that the sheet 3 can start turning without applying excessive loads to the sheet 3 or the register rollers 17A, 17B.

Figure 9:
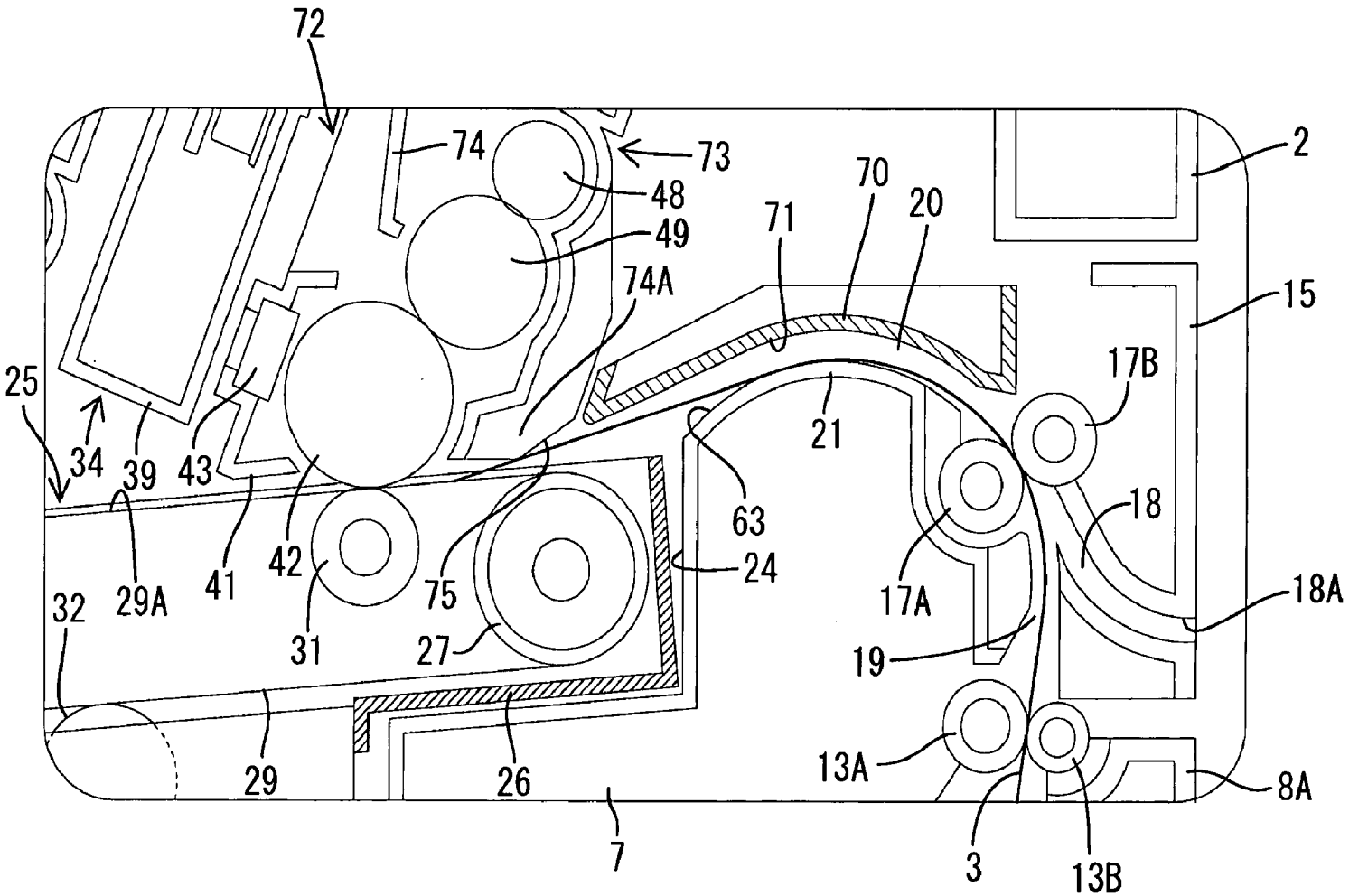
FIG. 9 is an enlarged sectional side view showing a periphery of a chute according to another illustrative aspect.

Illustrative aspects will be described with reference to FIG. 9. It should be noted that similar reference numerals denote similar components with respect to illustrative aspects described above and will be omitted for brevity.

A developing cartridge 73 is removably installed in a process cartridge 72 such that a lower end 74A of a case 74 of the developing cartridge 73 is disposed, downstream of the a chute 70 having a guide surface 71, above the conveying belt 29 so as to face the conveying surface 29A. A guide 75 where the leading edge of the sheet 3 is slidable is provided on the lower end 74A of the case 74, in a continuous manner with the guide surface 71 of the chute 70. The guide 75 faces frontward and downward. The guide 75 and the guide surface 71 of the chute 70 form a concavely curved surface. In other words, the lower end 74A of the case 74 functions, in cooperation with the chute 70, as a chute, and conveys the sheet 3, while curving the sheet 3, onto the conveying belt 29.

In these aspects, the guide 75, which functions as a part of the chute, is formed on the case 74 of developing cartridge 73, so that the size of the printer 1 can be reduced. In addition, the part of the chute is replaced when the process cartridge 72 is replaced with new one. Therefore, maintenance of the printer 1 can be readily performed even when the guide 75 is worn out by the friction between the sheet 3 and the guide 75. A part of the chute is formed on the case 74 of the developing cartridge 73, so that the sheet 3 can be guided nearer to the photosensitive drum 42 and the transfer roller 31.

Figure 10:
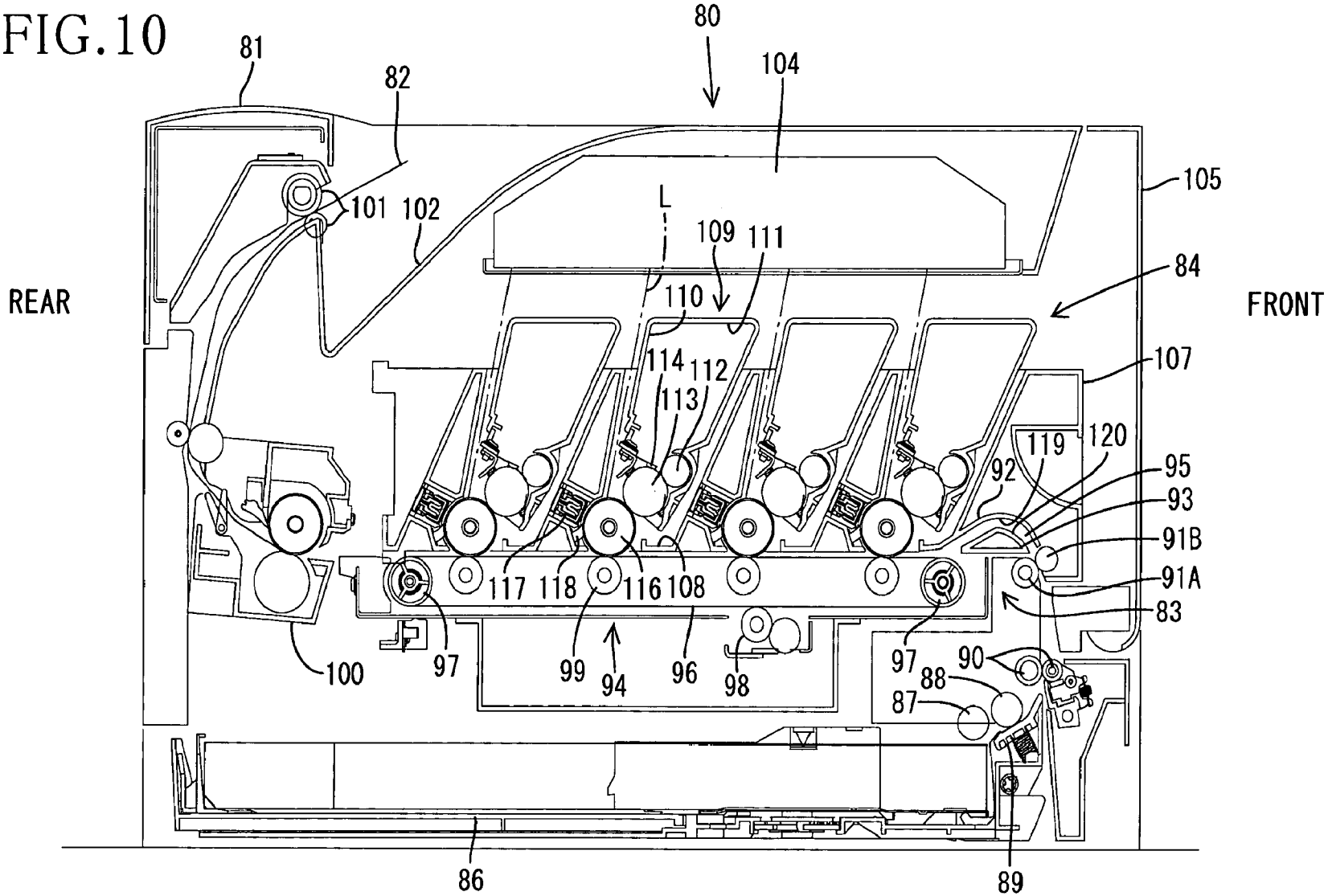
FIG. 10 is a side sectional view of an overall configuration of a color laser printer according to another illustrative aspect.
Figure 11:
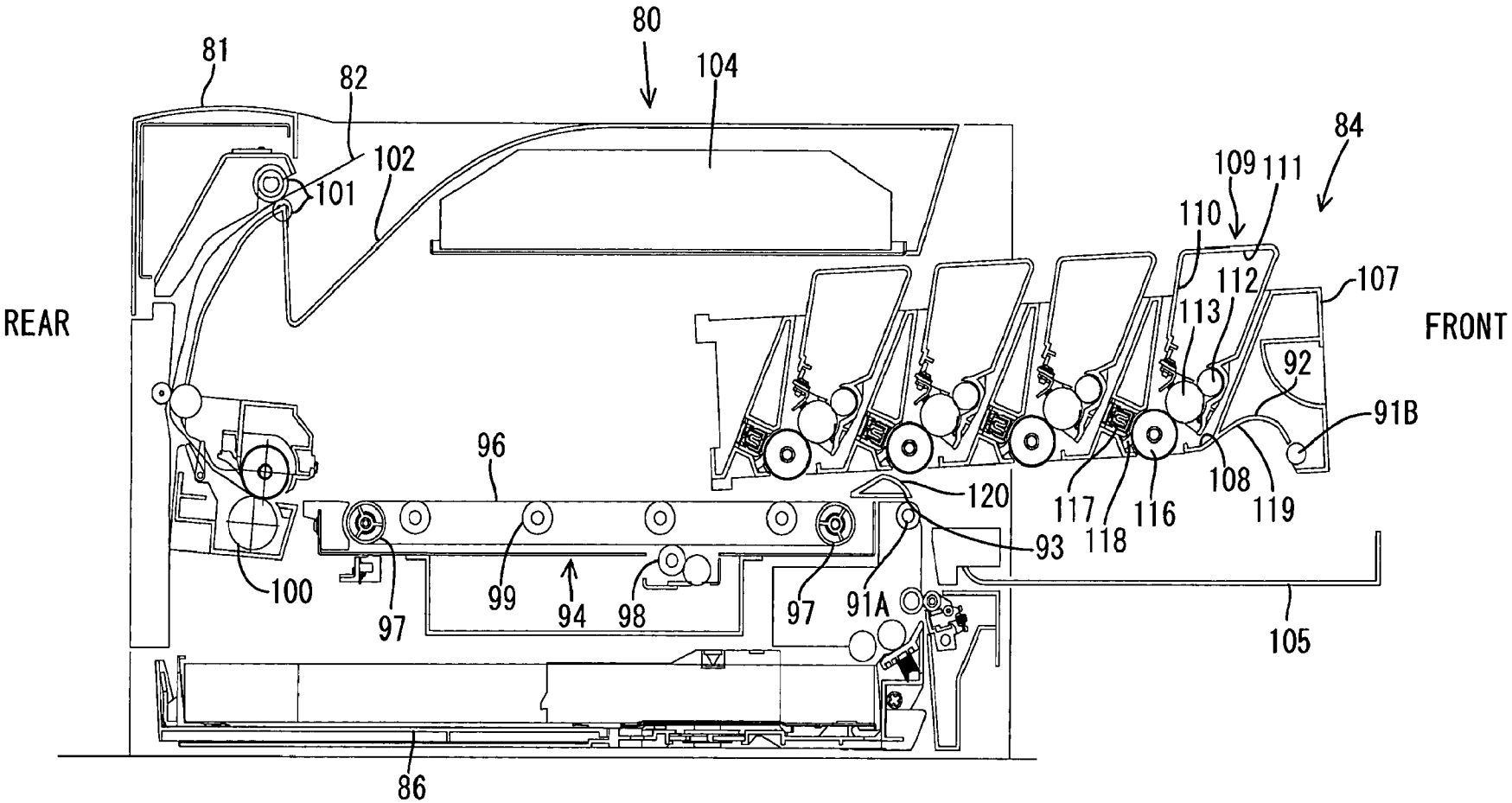
FIG. 11 is a sectional side view of the laser printer showing a state in which an image forming unit is removed from the laser printer according to illustrative aspects of the invention.

Illustrative aspects will be described below with reference to FIGS. 10 and 11. It should be noted that similar reference numerals denote similar components as described and detailed description of these are omitted.

A laser printer 80 is a direct tandem color laser printer including four photosensitive drums 116 in association with four colors of black, cyan, magenta, and yellow. The printer 80 is provided in a main casing 81 with a sheet conveying device 83 that conveys a sheet 82, as a recording medium, and an image forming unit 84 that forms an image onto the sheet 82 conveyed by the sheet conveying device 83. The right side in FIG. 10 is defined as the front side and the left side as the rear side.

A sheet supply cassette 86 that is slidable toward the front side is provided at a lower side of the main casing 81. The sheet 82 held in the sheet supply cassette 86 is supplied to register rollers 91A, 91B of the sheet conveying device 83 by a pick-up roller 87, a sheet supply roller 88, a separation pad 89, and a pair of sheet power removing rollers 90.

The sheet conveying device 83 includes a pair of the register rollers 91A, 91B, a chute 92, an inner chute 93, and a belt unit 94. The sheet 82 fed by the register rollers 91A, 91B is conveyed through a sheet feed path 95 defined between the chute 92 and the inner chute 93, to a conveying belt 96 of the belt unit 94. The belt unit 94 includes a pair of front and rear-side belt supporting rollers 97, the conveying belt 96, a cleaning roller 98, and transfer rollers 99. The belt unit 94 is detachably attachable to the main casing 81. While the sheet 3 is fed on the conveying belt 96 to the rear side in the sheet feeding direction, images associated with the respective colors are transferred on the sheet 3 by photosensitive drums 116 of the image forming unit 84 and the transfer rollers 99. The sheet 3 having the images transferred thereon is discharged by discharge rollers 101 on a discharge tray 102 provided on the upper face of the main casing 81, via a fixing unit 100 disposed behind the belt unit 94.

A scanner unit 104, as an exposure device, that emits the laser beam L to the photosensitive drums 116, is disposed at an upper portion of the main casing 81. The image forming unit 84 is disposed between the scanner unit 104 and the conveying belt 96. A front cover 105, which can be open or closed, is disposed on the front side of the main casing 81. By opening the front cover 105, the image forming unit 84 can be drawn toward the front side, as shown in FIG. 11. The image forming unit 84 includes a frame 107 of a substantially box shape. Four cartridge installation portions 108 that are open upward are disposed in the frame 107 in line along the front-rear direction. Four developing cartridges 109 associated with each of four colors are detachably installed in the respective cartridge installation portions 108. Each developing cartridge 109 is provided in a case 110 with a toner chamber 111, a supply roller 112, a developing roller 113, and a layer-thickness regulating blade 114. In the frame 107, the photosensitive drums 116 are supported at a lower portion of each cartridge installation portion 108 so as to face the developing roller 113 and the transfer roller 99. A scorotron charger 117 and a cleaning brush 118 are disposed near the photosensitive drum 116. The chute 92 having a guide surface 119 that concavely curves is integrally formed with a front bottom portion of the frame 107. The register roller 91B is supported at a front end (upstream end) of the chute 92. Disposed are in the main casing 81 are the register roller 91A and the inner chute 93 having an upwardly curving guide surface 120, which faces the guide surface 119 when the image forming unit 84 is set in the main casing 81.

In the laser printer 80, the image forming unit 84 is drawn from the main casing 81 to replace the developing cartridges 109. As the image forming unit 84 is removed out from the main casing 81, a portion above the conveying belt 96 and the sheet feed path 95 become free. Therefore, the sheet jam clearing operation or maintenance operations, such as the replacement of the conveying belt 96, can be readily performed.

While has aspects of the invention have been described above, various alternatives, modifications, variations, improvements and/or substantial equivalents, whether known or that are or may be presently unforeseen, may become apparent to those having at least ordinary skill in the art. Accordingly, the aspects, as set forth above, are intended to be illustrative, not limiting. Various changes may be made without departing from the spirit and scope of the disclosure. Therefore, the disclosure is intended to embrace all known or later developed alternatives, modifications, variations, improvements and/or substantial equivalents.

For example, the guide surface is provided on the chute. However, a rib that concavely curves along the sheet feeding direction may be provided on a surface of the chute, as a guide portion, where the leading edge of the recording medium slides. A rib may also be disposed on the upwardly curving guide surface of the inner chute.

The recording medium on which an image is recorded may be a plastic film or sheet, such as an overhead transparency film, or cloth, other than a paper sheet.

A cartridge according to some aspects includes the photosensitive drum and the developing cartridge while the cartridge according to other aspects may include only the developing cartridge. In still further aspects the cartridge may include only the photosensitive drum separately from the developing cartridge.

What is claimed is:

1. An image forming apparatus, comprising:

a casing, a conveyor configured to convey a recording medium along a conveying surface thereof, a first feeding roller configured to feed the recording medium toward the conveyor, and a first guide surface configured to guide the recording medium fed by the first feeding roller onto the conveyor, the first guide surface being disposed between the conveyor and the first feeding roller, a cartridge removably installed in the casing, the cartridge including:

a frame, a photosensitive drum configured to carry an electrostatic latent image thereon, the photosensitive drum supported by the frame, a second guide surface configured to guide the recording medium onto the conveyor, and a second feeding roller disposed at an end of the second guide surface;

wherein the second guide surface has a guide portion on which a leading edge of the recording medium is configured to slide, the guide portion being concavely formed, wherein the first guide surface and the second guide surface oppose each other and form a feeding path along which the recording medium is configured to be fed in a state where the cartridge is installed in the casing, and wherein the first feeding roller and the second feeding roller are disposed at an end of the feeding path in a state where the cartridge in installed in the casing.

2. The image forming apparatus according to claim 1, wherein the conveyor includes a conveying belt, and wherein the transfer device includes a transfer roller, the transfer roller being disposed on an inner side of the conveying belt, downstream of a belt supporting roller that contacts the conveying belt and is disposed nearest to the first guide surface, and wherein the first guide surface is configured to cause a leading edge of the recording medium to contact the conveying belt between a supporting position of the belt supporting roller, and a position where the transfer roller contacts the conveying belt.

3. The image forming apparatus according to claim 1, further comprising:

a supply unit configured to hold recording media and supply the recording media to the feeding roller; and a discharge tray on which the recording media fed by the conveyor, which conveys the recording media fed from the first feeding roller, is discharged, wherein the supply unit, the conveyor and the discharge tray are disposed so as to overlap in a single direction.

4. The image forming apparatus according to claim 1, wherein the casing comprises a door, which covers an opening in a closed state, and wherein the cartridge is removably installable through the opening when the door is in an open state.

5. The image forming apparatus according to claim 4, wherein the cartridge further comprises a grip portion, which is exposed externally when the door is in the open state.

6. The image forming apparatus according to claim 1, wherein the first feeding roller and the second feeding roller are configured to reduce skew of the recording medium by stopping the feeding of the recording medium before the recording medium is fed into the feeding path formed by the first guide surface and the second guide surface.

7. A cartridge removably installed in a casing of an image forming apparatus, the image forming apparatus comprising:

a conveyor configured to convey a recording medium along a conveying surface thereof, a first feeding roller configured to feed the recording medium toward the conveyor, and a first guide surface configured to guide the recording medium fed by the first feeding roller onto the conveyor, the first guide surface being disposed between the conveyor and the first feeding roller, the cartridge comprising:

a frame, a photosensitive drum configured to carry an electrostatic latent image thereon, the photosensitive drum supported by the frame, a second guide surface configured to guide the recording medium onto the conveyor, a second feeding roller disposed at an end of the second guide surface;

wherein the second guide surface has a guide portion on which a leading edge of the recording medium is configured to slide, the guide portion being concavely formed, and wherein the first feeding roller and the second feeding roller are configured to reduce skew of the recording medium before feeding the recording medium onto the conveyor.

8. The cartridge according to claim 7, further comprising a developer cartridge configured to form a visible image by applying a developing agent to the electrostatic latent image formed on the photosensitive drum, the developer cartridge comprises a developing roller that opposes the photosensitive drum, wherein the developer cartridge is removably installable to the cartridge.

* * * * *